US005333323A

United States Patent [19]

Aymes

[11] Patent Number: 5,333,323

[45] Date of Patent: Aug. 2, 1994

[54] SWIMMING POOL WITH LADDER

[76] Inventor: Doniel G. Aymes, P.O. Box 1783, New Brunswick, N.J. 08902

[21] Appl. No.: 948,124

[22] Filed: Sep. 21, 1992

[51] Int. Cl.[5] ..... E04H 4/00

[52] U.S. Cl. ..... 4/496; 4/504; 182/93; 182/97

[58] Field of Search ..... 4/496, 504, 511, 506, 4/507, 571, 574; 182/93, 97, 113, 106, 118

[56] References Cited

U.S. PATENT DOCUMENTS

| | | | |
|---|---|---|---|
| 3,539,033 | 11/1970 | Schwarz | 182/97 |
| 3,908,795 | 9/1975 | Gannon | 182/93 |
| 4,023,647 | 5/1977 | Confer | 182/118 |
| 4,418,792 | 12/1983 | Cerone | 182/106 |
| 4,848,515 | 7/1989 | Rinke | 182/106 |
| 4,997,061 | 3/1991 | Aymes | 182/118 |
| 5,044,465 | 9/1991 | Rinke | 182/106 |

*Primary Examiner*—Henry J. Recla

*Assistant Examiner*—Charles R. Eloshway

*Attorney, Agent, or Firm*—R. Neil Sudol; Henry D. Coleman

[57] ABSTRACT

A swimming pool structure comprises a swimming pool sidewall defining a pool area, an elevated deck attached to the sidewall along an upper rim thereof, and a pair of ladder side rails extending from the deck into a water-holding pool area defined by the sidewall, the side rails being connected at upper ends to at least one of the sidewall and the deck. The ladder side rails are provided with elements for ensuring that the side rails are oriented at an acute angle with respect to the pool sidewall. A pair of hand rails are connected to the respective side rails and extend inwardly therefrom into the pool area. A plurality of steps are disposed between and connected to the side rails, while a pair of platform guard rails are connected to the deck in parallel with the side rails.

5 Claims, 2 Drawing Sheets

SWIMMING POOL WITH LADDER

BACKGROUND OF THE INVENTION

This invention relates to a swimming pool structure including an in-pool ladder.

Generally, all swimming pools larger than children's pools or wading pools are provided inside the pool with a ladder for facilitating exit from and, in some cases, entry into the pool. Invariably, these in-pool ladders are vertical ladders, without separate hand grips. When using such a ladder, a swimmer must grasp the ladder side rails between which the steps are disposed.

Such in-pool ladders are difficult to use, even for individuals who suffer no disability or physical disadvantage.

OBJECTS OF THE INVENTION

An object of the present invention is to provide a simming pool with an in-pool ladder which is easier to use than the conventional vertical in-pool ladder.

Another, more particular, object of the present invention is to provide a swimming pool with an in-pool ladder with hand rails separate from the ladder side rails.

A further particular object of the present invention is to provide a swimming pool with a staircase type in-pool ladder.

These and other objects of the present invention will be apparent from the drawings and detailed descriptions herein.

SUMMARY OF THE INVENTION

A swimming pool structure comprises, in accordance with the present invention, a swimming pool sidewall defining a pool area, a relatively elevated deck attached to the sidewall along an upper rim thereof, and a pair of ladder side rails extending from the deck into a water-holding pool area defined by the sidewall, the side rails being connected at upper ends to at least one of the sidewall and the deck. The ladder side rails are provided with elements for ensuring that the side rails are oriented at an acute angle with respect to the pool sidewall. A pair of hand rails are connected to the respective side rails and extend inwardly therefrom into the pool area. A plurality of steps are disposed between and connected to the side rails, while a pair of platform guard rails are connected to the deck in parallel with the side rails.

Preferably, the guard rails are each in the form of an inverted letter U. Pursuant to another feature of the present invention, each of the guard rails is connected to an uppermost step of the plurality of steps.

According to another feature of the present invention, the side rails of the ladder assembly are connected to the pool sidewall or the deck via at least one hinge.

A swimming pool with an in-pool staircase type ladder in accordance with the present invention is substantially easier to use than the universal vertical in-pool ladders. The invention thus contemplates facilitated use of swimmming pools by the elderly and handicapped individuals.

DETAILED DESCRIPTION

Figure 1:
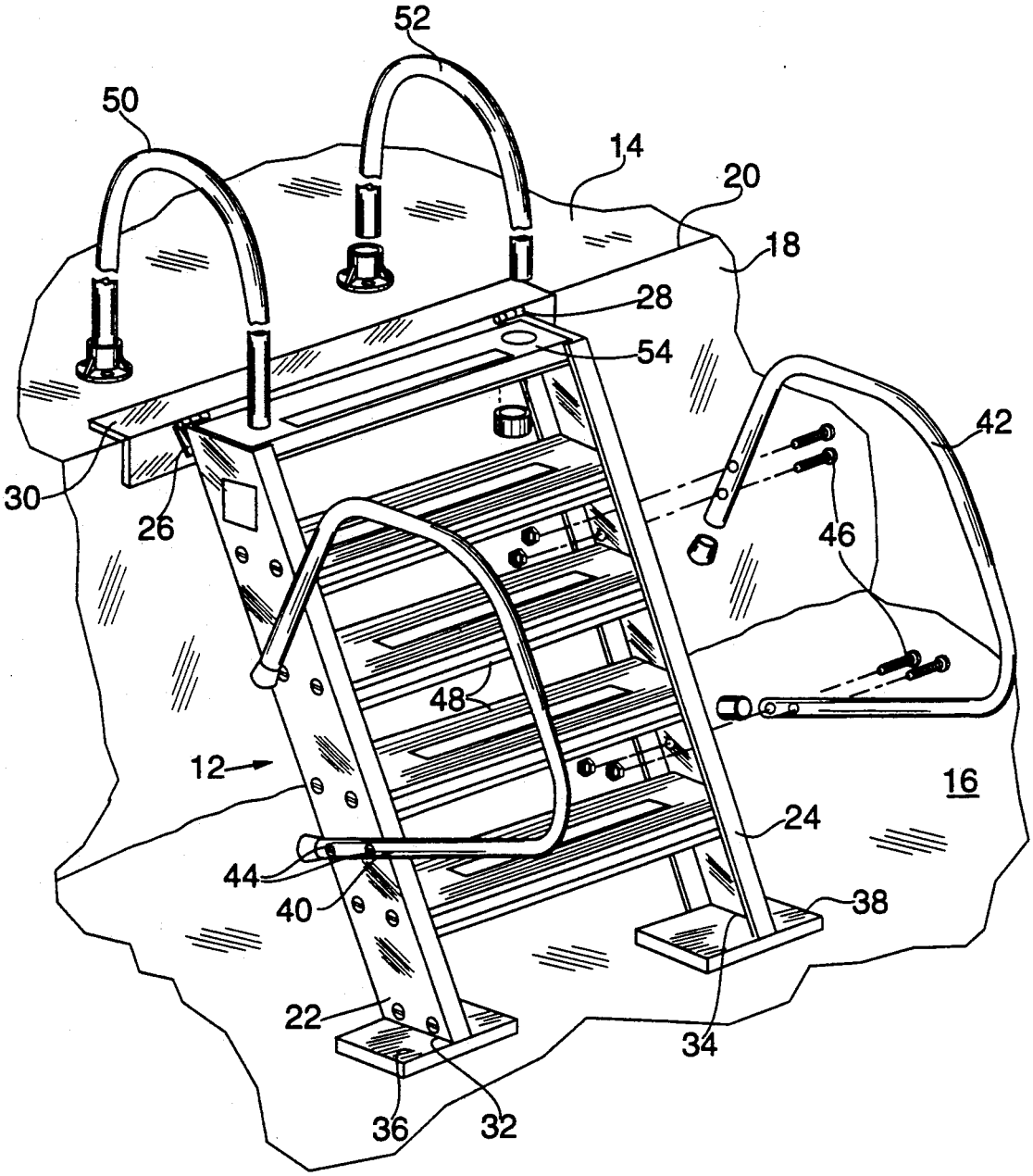
FIG. 1 is a partially exploded isometric view of a pool structure including an in-pool staircase type ladder in accordance with the present invention.
Figure 2:
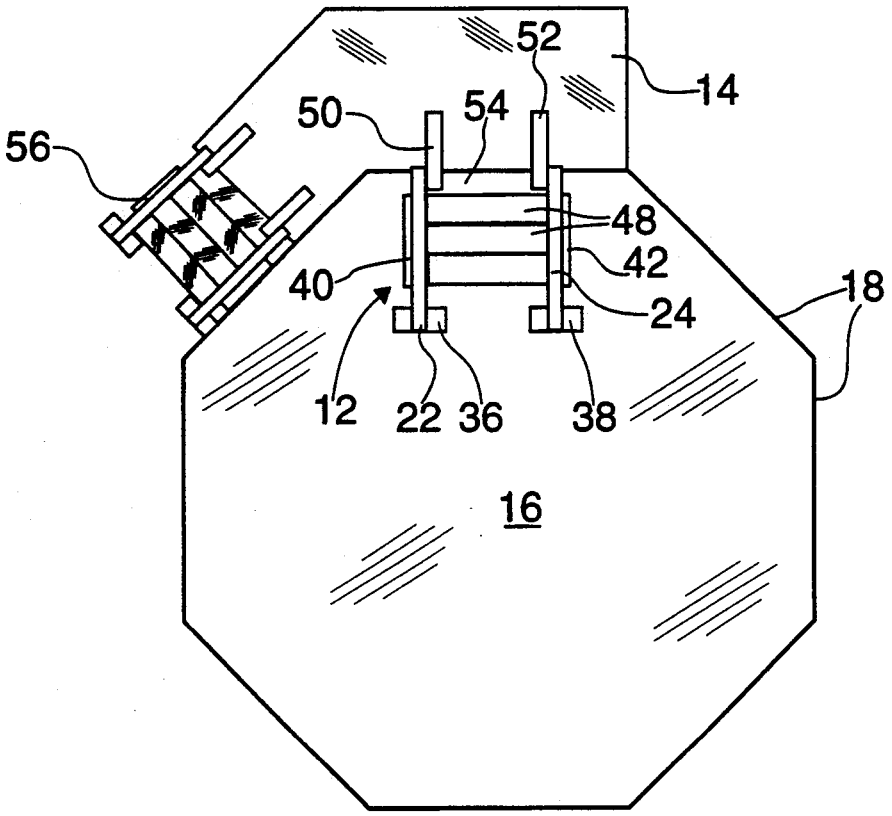
FIG. 2 is a schematic top plan view of a pool showing the locations of the ladder of FIG. 1.

As illustrated in FIGS. 1 and 2, a staircase type ladder 12 extends from a relatively elevated deck 14 into a water-holding pool area 16 defined by a vertical pool sidewall 18. Deck 14 is attached to sidewall 18 along an upper rim or edge 20 thereof.

Staircase ladder 12 includes a pair of side rails 22 and 24 extending downwardly and inwardly from deck 14. Side rails 22 and 24 are connected at upper ends to either sidewall 18 or deck 14. In the illustrated embodiment, side rails 22 and 24 are connected via respective hinges 26 and 28 to an angle piece 30 in turn connected to deck 14.

Ladder side rails 22 and 24 are provided along their angled lower ends 32 and 34 with plates 36 and 38 for ensuring that the side rails are oriented at an acute angle with respect to pool sidewall 18, i.e, for ensuring that the ladder 12 extends inwardly into the pool area 16, and not vertically. A pair of hand rails 40 and 42 are connected via bolts 44 and 46 to respective side rails 22 and 24 and extend inwardly therefrom into pool area 16.

A plurality of steps 48 are disposed between and connected to side rails 22 and 24. A pair of platform guard rails 50 and 52 are connected to deck 14 in parallel and in essential alignment with side rails 22 and 24. Guard rails 50 and 52 are each in the form of an inverted letter U. Each guard rail 50 and 52 is connected to an uppermost step 54 of staircase ladder 12.

To make more room in the pool, ladder 12 may be swung out or the pool about hinges 26 and 28 and supported on deck 14 in an inverted orientation.

A conventional staircase type ladder 56 extends from deck 14 to a ground surface outside pool area 16.

Although the invention has been described in terms of particular embodiments and applications, one of ordinary skill in the art, in light of this teaching, can generate additional embodiments and modifications without departing from the spirit of or exceeding the scope of the claimed invention. For example, although the illustrations herein are directed to an above-ground pool, it is clear that the invention pertains to in-ground pools as well.

Accordingly, it is to be understood that the drawings and descriptions herein are profferred by way of example to facilitate comprehension of the invention and should not be construed to limit the scope thereof.

What is claimed is:

1. A swimming pool structure comprising:

a swimming pool sidewall defining a pool area;

an elevated deck attached to said sidewall along an upper rim thereof;

a pair of ladder side rails extending from said deck into a water-holding pool area defined by said sidewall, said side rails being connected at upper ends to at least one of said sidewall and said deck;

angling means connected to said side rails for ensuring that said side rails are oriented at an acute angle with respect to said sidewall;

a pair of hand rails connected to respective ones of said side rails and extending inwardly therefrom into said pool area;

a plurality of steps disposed between and connected to said side rails; and a pair of platform guard rails connected to said deck in parallel with said side rails;

wherein each of said guard rails is connected to an uppermost step of said plurality of steps.

2. The structure defined in claim 1 wherein said guard rails are each in the form of an inverted letter U.

3. The structure defined in claim 1 wherein said side rails are connected to said at least one of said sidewall and said deck via at least one hinge.

4. A swimming pool structure comprising:

a swimming pool sidewall defining a pool area;

an elevated deck attached to said sidewall along an upper rim thereof;

a staircase type ladder extending from said upper rim at said deck into said pool area, said staircase type ladder having a pair of hand rails; and a pair of U-shaped guard rails extending upwardly from deck at said ladder;

wherein each of said guard rails is connected to an uppermost step of said ladder.

5. The structure defined in claim 4 wherein said ladder is connected to at least one of said sidewall and said deck via at least one hinge.

* * * * *